US006216925B1

(12) United States Patent
Garon

(10) Patent No.: US 6,216,925 B1
(45) Date of Patent: Apr. 17, 2001

(54) AUTOMATIC AEROSOL DISPENSER

(75) Inventor: Mark Garon, Ste-Hyacinthe (CA)

(73) Assignee: Multi-Vet Ltd., Quebec (CA)

( * ) Notice: Subject to any disclaimer, the term of this patent is extended or adjusted under 35 U.S.C. 154(b) by 0 days.

(21) Appl. No.: 09/326,793

(22) Filed: Jun. 4, 1999

(51) Int. Cl.[7] ..... G04C 23/00
(52) U.S. Cl. ..... 222/645
(58) Field of Search ..... 222/504, 645, 222/646, 648, 649

(56) References Cited

U.S. PATENT DOCUMENTS

| | | | | |
|---|---|---|---|---|
| 2,695,766 | * | 11/1954 | Peltz | 222/648 |
| 3,289,886 | | 12/1966 | Goldsholl et al. . | |
| 3,627,176 | | 12/1971 | Sailors | 222/70 |
| 3,666,144 | | 5/1972 | Winder | 222/70 |
| 3,952,916 | | 4/1976 | Phillips | 222/70 |
| 3,974,941 | | 8/1976 | Mettler | 222/70 |
| 4,415,797 | * | 11/1983 | Choustoulakis | 222/646 |
| 5,025,962 | | 6/1991 | Renfro | 222/649 |
| 5,249,718 | | 10/1993 | Muderlak | 222/642 |
| 5,676,283 | | 10/1997 | Wang | 222/649 |

FOREIGN PATENT DOCUMENTS 2 623 780 6/1989 (FR) ..... B65D/83/14

* cited by examiner

*Primary Examiner*—Philippe Derakshani
*Assistant Examiner*—Thach H Bui
(74) *Attorney, Agent, or Firm*—Swabey Ogilvy Renault

(57) ABSTRACT

The present invention relates to aerosol dispensers and more particularly to automatic aerosol dispensers. In accordance with the present invention, there is provided a portable automatic aerosol dispenser device for intermittently releasing a dose of an aerosol from an aerosol can to an environment. The portable automatic aerosol dispenser device comprises a housing, which comprises an aerosol release mechanism adapted to release the dose of aerosol from the can to the environment, an outlet connected to the aerosol release mechanism for releasing the dose of aerosol through the housing, an inlet connected to the aerosol release mechanism for receiving a stem of the can, an actuating mechanism adapted to actuate the aerosol release mechanism intermittently, the actuating mechanism comprising a switch mechanism for switching the aerosol release mechanism from an inoperative position to an operative position for an interval of time and a timing mechanism for controlling the interval of time, and a gripping mechanism adapted to grip a rim of the can, for releasably gripping the housing to the rim. The automatic aerosol dispenser device may be used with an aerosol can of any size.

13 Claims, 3 Drawing Sheets

AUTOMATIC AEROSOL DISPENSER

BACKGROUND OF THE INVENTION (a) Field of the Invention

The present invention relates to aerosol dispensers and more particularly to automatic aerosol dispensers.

(b) Description of the Prior Art

Aerosol cans are used to propel a variety of active ingredients such as air fresheners, repellants and the like. An aerosol can generally consists of a cylindrical vessel having an upper part thereof closed with a lid having a standard rim size. The center of the lid is provided with an aperture through which a conduit is inserted, at the top of which is mounted a dispenser valve actuator and a dispensing head having a dispenser nozzle. The aerosol can is generally activated manually, by depressing the dispensing head, thereby actuating the valve and releasing the aerosol with the active ingredient contained in the can, through the nozzle. The dispensing head is generally protected with a cap, which is snap fitted to the can.

Automatic dispensers comprising a housing in which an aerosol can is inserted are known. For example, French Patent Application No. 2 623 780, published Jun. 2, 1989, describes an automatic dispenser consisting of a shell having an upper part and a lower part fitted together after the aerosol can is inserted in the lower part thereof. Other examples include U.S. Pat. No. 3,952,916 issued on Dec. 6, 1966 to Phillips, U.S. Pat. No. 3,974,941 issued on Apr. 27, 1976 to Mettler, U.S. Pat. No. 5,249,718 issued on Oct. 5, 1993 to Muderlak and U.S. Pat. No. 5,676,283 issued on Oct. 14, 1997 to Wang. A problem with such dispensers resides in the fact that they are useless with aerosol cans having a diameter larger than that of the shell. Another problem with such dispensers is that they are expensive and complicated to manufacture.

There exist dispensers which may be mounted to the aerosol can. For example, reference is made to U.S. Pat. No. 3,289,886 issued on Dec. 6, 1966 to Goldsholl, U.S. Pat. No. 3,666,144 issued on May 30, 1972 to Winder, U.S. Pat. No. 3,627,176 issued on Dec. 14, 1971 to Sailors and U.S. Pat. No. 5,025,962 issued on Jun. 25, 1991 to Renfro. A problem with such dispensers is that they are not secured to the aerosol can. For example, such an automatic dispenser may fall off the aerosol can and be permanently damaged. Moreover, they remain bulky, which is unattractive to customers.

It would therefore be highly desirable to provide an inexpensive automatic aerosol dispenser device that could be used with an aerosol can of any size, and that could be secured thereto.

SUMMARY OF THE INVENTION

One aim of the present invention is to provide an inexpensive automatic aerosol dispenser device that may be used with an aerosol can of any size and that may be secured to a rim of constant, universal diameter on the aerosol can.

In accordance with the present invention, there is provided a portable automatic aerosol dispenser device for intermittently releasing a dose of an aerosol from an aerosol can to an environment, wherein the can is provided with a stem valve concentric with a universal rim on the top of the can. The portable automatic aerosol dispenser device comprises a housing, which comprises an aerosol release mechanism adapted to release the dose of aerosol from the can to the environment when actuated, an outlet connected to the aerosol release mechanism permitting the releasing of the dose of aerosol through the housing, an inlet connected to the aerosol release mechanism for receiving the stem valve of the can, an actuating mechanism adapted to actuate the aerosol release mechanism intermittently, the actuating mechanism comprising a switch mechanism for switching the aerosol release mechanism from an inoperative position to an operative position for an interval of time and a timing mechanism for controlling the interval of time, and a gripping mechanism adapted to grip the rim of the can, for releasably clamping the housing to the rim.

The gripping mechanism may comprise a plurality of projections adapted to grip the rim, the projections each comprising a first portion downwardly extending from a side wall of the housing and a second portion connected to the first portion and inwardly directed relative to the side wall, the projections each comprising an outer surface comprising external threads, a ring member comprising an inner surface comprising internal threads, the internal threads of the ring corresponding to the external threads of the projections, the ring member being displaceable between an inoperative position and an operative position, whereby when the portable automatic aerosol dispenser device is downwardly urged against the rim, the projections are outwardly displaced to grip the rim, and the projections are secured to the rim when the ring member is in the operative position.

The aerosol release mechanism may comprise a solenoid valve.

The actuating mechanism may comprise an electronic control panel.

In accordance with the present invention, there is further provided an apparatus for intermittently releasing a dose of an aerosol can to an environment, the apparatus comprising an aerosol can containing an aerosol with an active ingredient, the aerosol can being closed by a lid having a rim and a stem valve mounted thereto for releasing the aerosol from the can, an automatic aerosol dispenser device mounted to the rim, for intermittently releasing a dose of the aerosol to an environment, the automatic aerosol dispenser device comprising a housing, the housing comprising an aerosol release mechanism adapted to release the dose of aerosol from the can to the environment when actuated, an outlet connected to the aerosol release mechanism for releasing the dose of aerosol through the housing, an inlet connected to the aerosol release mechanism for receiving said stem valve, an actuating mechanism adapted to activate the aerosol releasing mechanism intermittently, the actuating mechanism comprising a switch mechanism for switching the aerosol release mechanism from an inoperative position to an operative position for an interval of time, and a timing mechanism for controlling the interval of time, and a gripping mechanism adapted to grip the housing to the rim.

The gripping mechanism may comprise a plurality of projections adapted to grip the rim, the projections each comprising a first portion downwardly extending from a side wall of the housing and a second portion connected to the first portion and inwardly directed relative to the side wall, the projections comprising an annular outer surface comprising external threads, a ring member comprising an inner surface comprising internal threads, said internal threads essentially corresponding to the external threads of the projections, the ring member being displaceable between an inoperative position and an operative position, whereby upon the automatic aerosol dispenser device being downwardly urged against the rim and the rim being in the inoperative position, the projections are outwardly displaced and grip the rim, and the projections are secured to the rim when the ring member is in the operative position.

The aerosol may comprise an active ingredient, and the active ingredient may be selected from a group consisting of air fresheners, repellants, hormonal compounds and lubricants.

The environment may be a space such as a room or a surface.

The dose of aerosol may be released during a determined period of time. The period of time during which the valve is kept in the operative position and the intervals of time during which the valve is kept in the inoperative position may be set by the user through programming of the portable automatic aerosol dispenser device or may be pre-programmed during the manufacturing process.

The portable automatic aerosol dispenser device of the present invention may be used with valves such as continuous flow valves. The portable automatic aerosol dispenser device of the present invention may be used with valves such as Precision valves and may be adapted to other sizes and formats of valves.

The valve may be controlled with mechanisms such as timers, remote controls, motion detectors and switches provided to the housing of the portable automatic aerosol dispenser device.

For example, an air freshener for a public washroom may be automatically activated with a timer such that every few minutes, the portable automatic aerosol dispenser device releases a dose of aerosol in the washroom.

BRIEF DESCRIPTION OF THE DRAWINGS

Having thus generally described the nature of the invention, reference will now be made to the accompanying drawings, showing by way of illustration preferred embodiments thereof, in which like numerals refer to like components and in which.

DETAILED DESCRIPTION OF THE INVENTION

The present invention will now be more readily understood by referring to the following examples which are given to illustrate the invention rather than to limit its scope.

The present invention consists of a portable automatic aerosol dispenser integrated in an aerosol can cap, which may be secured to the lid rim of an aerosol can.

Figure 1:
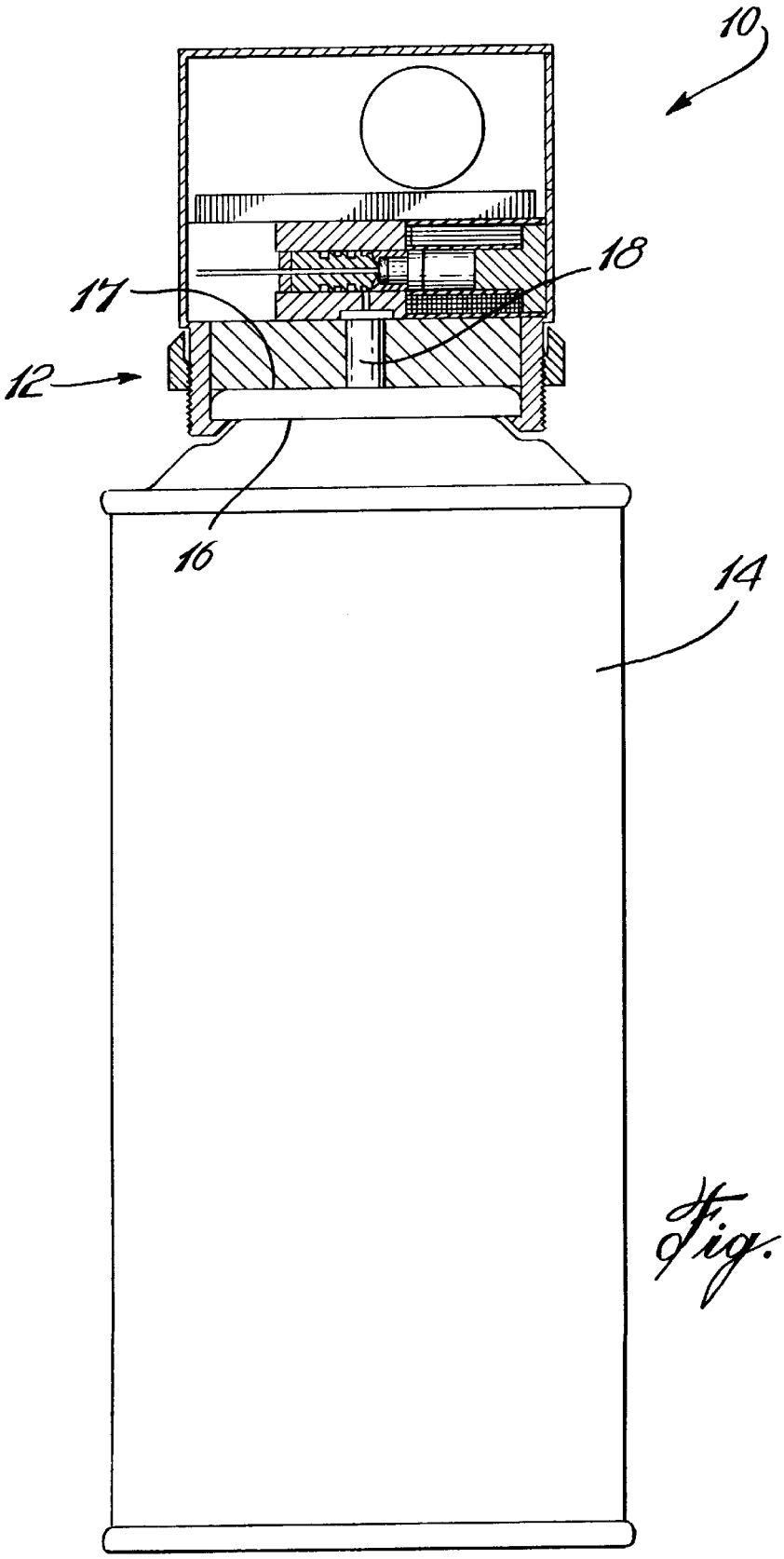
FIG. 1 is an elevation view of an aerosol can with a first embodiment of a portable automatic aerosol dispenser device in accordance with the present invention mounted thereto and shown in a cross-sectional view.

As may be seen in FIG. 1, the automatic aerosol dispenser 10 comprises a gripping mechanism 12 adapted to grip an aerosol can 14 at the rim 16 of the lid 17 closing the aerosol can 14. A stem 18 is projecting upwardly from the lid 17. The automatic aerosol dispenser 10 is adapted to attach to an aerosol can 14 of any size, and is more particularly adapted to attach to the one-inch lid, which is a standard in the aerosol can industry.

Figure 2:
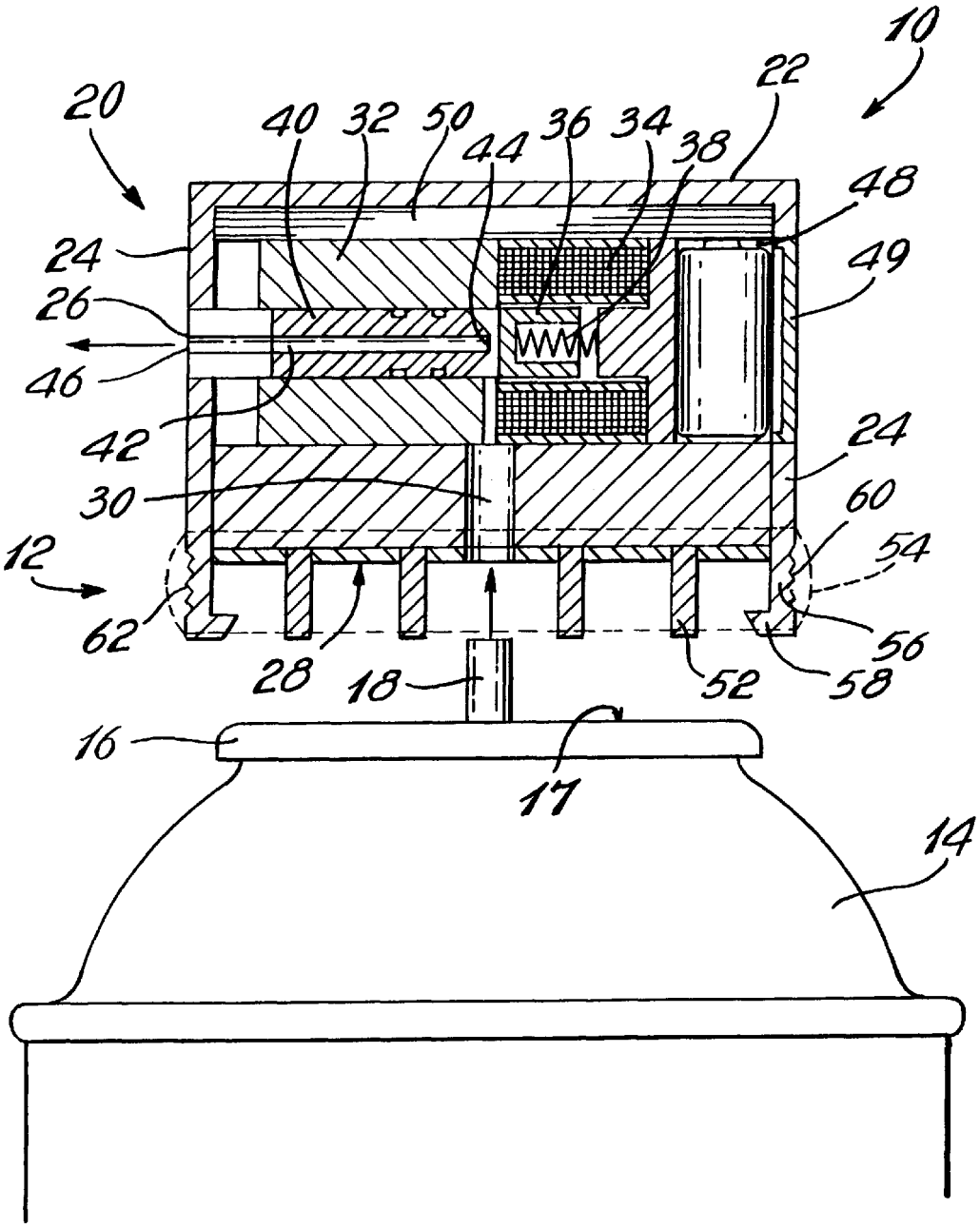
FIG. 2 is a fragmentary, partly in cross section showing one view of the components shown in FIG. 1 seperated from the other and showing the valve in the open position.

As may be seen in FIG. 2, the automatic aerosol dispenser 10 comprises a cylindrical housing 20, the dimensions of which correspond essentially to those of an aerosol can cap. The size of the embodiment herein described in about 1.5 square inches. The housing 20 may be molded from plastic. The housing 20 has a circular top wall 22 and a side wall 24 downwardly extending from the rim of the top wall 22. An outlet opening 26 is defined by the side wall 24. The positioning of the outlet opening 26 to the side wall 24 of the housing 20 allows the automatic dispenser device 10 to be used in an inverted position when required. A bottom wall 28 is connected to the side wall 24 at a lower area thereof. An inlet opening 30 is provided at the center of the bottom wall 28. The inlet opening 30 is adapted to receive the stem 18 of the aerosol can 14.

Figure 3:
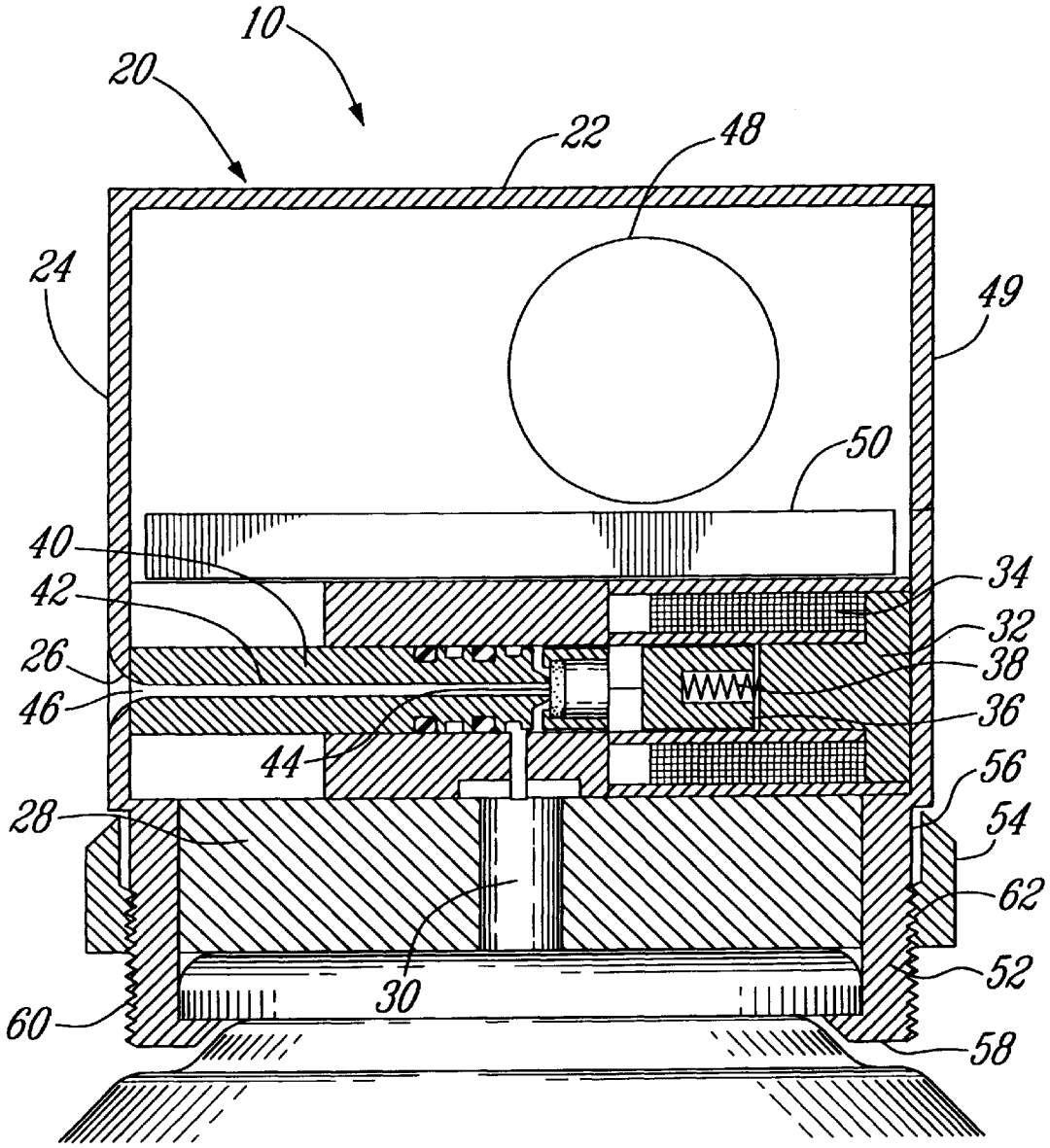
FIG. 3 is a cross-sectional view of a second embodiment of a portable automatic aerosol dispenser device in accordance with the present invention, shown mounted to the aerosol can and showing the valve in a closed position.

A valve 32 is disposed against the bottom wall 28 of the housing 20. The valve 32 has a coil 34 surrounding a plug 36 which, in response to a current flowing in the coil 34, is displaced between an inoperative position and an operative position by way of a biased spring 38. A valve seat 40 is provided at a distance of the plug 36 when the plug 36 is in the operative position (FIG. 3). The valve seat 40 defines an outlet channel 42 having a first opening 44 provided at an end facing the plug 36, and a second opening 46 at the opposite end, which is aligned with the outlet opening 26 provided to the side wall 24 of the housing 20.

When no current flows in the coil 34, the spring is unbiased and the valve 32 is closed in the inoperative position by the plug 36, which engages the valve seat 40 to close the first opening 44 and prevent the aerosol from passing into the outlet channel 44. When a current is flowed in the coil 34, the spring is biased and the plug 36 is displaced at a distance from the valve seat 40 to the operative position, leaving the aerosol to flow into the outlet channel 42 and to the outlet opening 26.

An electronic circuit board 50 is disposed above the valve 32. In the embodiment shown herein, the electronic circuit board 50 is a PCB. The PCB may comprise a hybrid or surface mount component. The PCB contains a microcontroller that controls the activation of the valve 32. The PCB controls the length of time the valve 32 is in the inoperative position, which is the interval between the releasing of the aerosol, and the length of time the valve is in the operative position, which is the length of time during which the aerosol is released from the aerosol can 14. The electronic circuit board 50 comprises a clock circuit for providing impulses at a determined frequency, a circuit for controlling the length of time during which the valve 32 is open and a circuit for controlling the length of time during which the valve 32 is closed. Each circuit comprises a divider circuit, a multiplexer circuit, a counter and a display. Other suitable valve actuation control mechanisms such as timers, remote controls, sensors, remote switches or the like may be used.

A battery seat 48 is disposed above the electronic circuit board 50, shown with a battery therein, for supplying power to the valve 32 and to the electronic circuit board 50. In the embodiment herein shown, the battery disposed in the seat 48 is a 6.0 volts camera type battery. An opening 49 closed with a door 49 is provided in the side wall 24 of the housing 20 for reaching the battery and replacing it when required. The opening of the door 49 may be located at any convenient wall of the housing 20. Any other suitable power source may be used.

The gripping mechanism 28 will now be described with reference to FIG. 3, which illustrates a second embodiment, which differs from the embodiment above-described in that the valve 32 is shorter, leaving room adjacent the coil 34 for the battery seat 48.

The gripping mechanism 28 comprises a plurality of fingers 52, which are adapted to grip the rim 16 of the aerosol can 14, and a ring 54.

The fingers 52 extend downwardly from the side wall 24, at a lower area thereof. Each finger 52 has a first portion 56, which is connected to the side wall 24, and a second portion 58 connected to the first portion 56, which is inwardly directed relative to a longitudinal axis following the center of the housing 20. The length of the first portion 56 is sufficient 25 to allow an outward displacement of the second portion 58 relative to the longitudinal axis when the fingers 52 are outwardly bent against the rim 16 of the aerosol can 14. The width of the second portion 58 of the fingers 52 is sufficient to grip the rim 16 at a bottom surface thereof. The fingers 52 are made of a resilient material such as plastic. Threads 60 are provided at an outer surface thereof.

The ring 54 has an inner diameter slightly superior to that of the housing 20. Threads 62 corresponding to the threads 60 of the fingers 52 are provided at an inner surface thereof. The ring 54 is screwed over the fingers 52 and displaceable between an inoperative position and an operative position, for securing the automatic dispenser device 10 to the aerosol can 14.

The automatic aerosol dispenser 10 is mounted to the aerosol can 14 by first removing the dispensing head which is generally mounted to the stem 18 of the aerosol can 14, by downwardly urging the fingers 52 against the rim 16 of the aerosol can 14 in a snap fit fashion while the ring 54 is in the inoperative position. The ring 54 is then screwed down to the operative position, thereby securing the automatic aerosol dispenser 10 to the aerosol can 14.

The automatic aerosol dispenser 10 operates as follows. The automatic aerosol dispenser 10 releases the aerosol contained in the aerosol can 14 to an environment at predetermined intervals of time. The aerosol can 14 has a valve that is in the open position. The release of the aerosol is controlled by the solenoid valve 32 of the automatic dispenser device 10.

The amount of aerosol to be released is determined by setting the period of time during which the valve 32 stays in the operative position. The valve 32 is kept in the operative position for the period of time that the coil 36 of the valve 32 remains charged.

While the invention has been described in connection with specific embodiments thereof, it will be understood that it is capable of further modifications and this application is intended to cover any variations, uses, or adaptations of the invention following, in general, the principles of the invention and including such departures from the present disclosure as come within known or customary practice within the art to which the invention pertains and as may be applied to the essential features hereinbefore set forth, and as follows in the scope of the appended claims.

What is claimed is:

1. A portable automatic aerosol dispenser device for intermittently releasing a dose of an aerosol from an aerosol can to an environment, wherein the can is provided with a stem valve concentric with a universal rim on the top of the can, the rim having an exterior portion, said portable automatic aerosol dispenser device comprising a housing, said housing comprising:

a) an aerosol release mechanism adapted to release said dose of aerosol from said can to said environment when actuated;

b) an outlet connected to said aerosol release mechanism permitting the releasing of said dose of aerosol through said housing;

c) an inlet connected to said aerosol release mechanism for receiving the stem valve of said can;

d) an actuating mechanism adapted to actuate said aerosol release mechanism intermittently;

the improvement comprising a gripping mechanism adapted to grip the rim of said can, for releasably clamping said housing to said rim, having a plurality of resilient projections adapted to grip said rim, said projections each comprising a first portion downwardly extending from a side wall of said housing and a second portion connected to said first portion and inwardly directed relative to said side wall, a ring member displaceable between an inoperative position and an operative position, whereby when said portable automatic aerosol dispenser device is downwardly urged against said rim, said resilient projections are outwardly displaced to grip said rim, and said second portion of each of said projections engage said rim to retain the dispenser on the aerosol can.

2. A portable automatic aerosol dispenser device according to claim 1, wherein said aerosol release mechanism comprises a solenoid valve.

3. A portable automatic aerosol dispenser device according to claim 2, wherein said actuating mechanism comprises an electronic control panel.

4. The portable automatic aerosol dispenser device defined in claim 1, wherein said actuating mechanism comprises a switch mechanism for switching said aerosol release mechanism from an inoperative to an operative position for an interval of time and a timing mechanism is provided for controlling said interval of time.

5. The portable automatic aerosol dispenser device as defined in claim 1, wherein a ring member is provided which is movable on the exterior of the housing between an inoperative position and an operative position whereby the ring member is displaced to an operative position when the projections grip the rim of an aerosol can, and the ring member surrounds the projections to secure the projections to the rim.

6. The portable automatic aerosol dispenser device as defined in claim 5, wherein the outer surfaces of the projections comprise external threads, and the rim member comprises an inner surface with internal threads, said internal threads of the rim corresponding to said external threads on the projection.

7. The portable automatic aerosol dispenser device as defined in claim 4, wherein the timing device includes an electronic circuit board with a PCB containing a microcontroller that controls the activation of the valve, the length of time the valve is in an inoperative position, and the length of time is in an operative position, the circuit board further comprises a clock circuit for providing impulses at a predetermined frequency.

8. An apparatus for intermittently releasing a dose of an aerosol can to an environment, said apparatus comprising:

a) an aerosol can containing an aerosol with an active ingredient and being closed by a lid having a rim and a stem valve mounted thereto for releasing said aerosol, the rim having an exterior portion; and b) an automatic aerosol dispenser device releasably mounted to said rim, for intermittently releasing a dose of said aerosol to an environment, said automatic aerosol dispenser device comprising a housing, a gripping mechanism adapted to grip said housing to said rim wherein the gripping mechanism comprises:

a plurality of projections adapted to grip said exterior portion of said rim, said projections each comprising a first portion downwardly extending from a side wall of said housing and a second portion connected to said first portion and inwardly directed relative to said side wall, a ring member comprising an inner surface, said ring member being displaceable between an inoperative position and an operative position;

whereby when said portable automatic aerosol dispenser device is downwardly urged against said rim, said resilient projections are outwardly displaced to grip said rim, and second portion on each projection is secured to said rim when said ring member is in said operative position.

9. A portable automatic aerosol dispenser device according to claim 8 wherein said active ingredient is selected from the group consisting of fresheners, repellants, hormonal pheromone compounds and lubricants.

10. The apparatus as defined in claim 8, wherein the ring member comprises an inner surface adapted to engage the housing in an inoperative position and the projections in an operative position, whereby when said portable automatic aerosol dispenser device is downwardly urging against the rim. resilient projections are outwardly displaced, and the ring member is moved towards the operative position to engage the projections and secure them against the rim.

11. The apparatus as defined in claim 10, wherein the outer surface of the projections are provided with external threads and the inner surface of the ring member comprises internal threads, said internal threads of the ring member corresponding to the external threads of projections.

12. The apparatus according to claim 1, wherein the housing comprises:

i) an aerosol release mechanism adapted to release said dose of aerosol from said can to said environment when actuated;

ii) an outlet connected to said aerosol release mechanism for releasing said dose of aerosol through said housing;

iii) an inlet connected to said aerosol release mechanism for receiving said stem; and iv) an actuating mechanism adapted to activate said aerosol releasing mechanism intermittently, said actuating mechanism comprising a switch mechanism for switching said aerosol release mechanism from an inoperative position to an operative position for an interval of time, and a timing mechanism for controlling said interval of time.

13. The apparatus as defined in claim 1, wherein the actuating mechanism includes a motion detector.

* * * * *